United States Patent [19]

Castelo

[11] 4,187,697

[45] Feb. 12, 1980

[54] JEWEL MOUNTING STRUCTURE

[76] Inventor: Angel Castelo, 9477 Brighton Way, Beverly Hills, Calif. 90210

[21] Appl. No.: 951,718

[22] Filed: Oct. 16, 1978

[51] Int. Cl.[2] ..... A44C 17/02; A44C 9/02

[52] U.S. Cl. ..... 63/31; 63/15

[58] Field of Search ..... 29/10; 63/31, 26, 15, 63/13

[56] References Cited

U.S. PATENT DOCUMENTS

| | | | |
|---|---|---|---|
| 553,708 | 1/1896 | Forehand | 63/31 |
| 645,909 | 3/1900 | Boismaure | 63/31 |
| 922,212 | 5/1909 | Tropin | 63/31 |
| 1,553,198 | 9/1925 | Stern | 63/31 |
| 2,585,183 | 2/1952 | Stern | 63/31 X |

FOREIGN PATENT DOCUMENTS

| | | | |
|---|---|---|---|
| 739455 | 7/1932 | France | 63/31 |
| 1381490 | 11/1964 | France | 63/31 |
| 197809 | 9/1978 | France | 63/31 |

*Primary Examiner*—Horace M. Culver
*Attorney, Agent, or Firm*—Michael A. Painter

[57] ABSTRACT

A design for a jewel mounting structure employing a moveable setting. A jewel or other stone to be exhibited is set upon a mounting sleeve which is adapted to slideably move along a curved guide surface having a predetermined radius of curvature. A connector depends radially inwardly from the sleeve and is journeled about a shaft which lies at the center of curvature of the guide surface. Affixed to the journaling element opposite the connector and sleeve is a weighted enclosure which will cause the sleeve to rotate about the shaft until gravitational forces maintain the weighted enclosure at the lowest point of its circular arc. The jewel or other stone being exhibited will be capable of slideably moving across the guide surface but will tend to be maintained at a location based upon the positional relationship of the weighted enclosure.

10 Claims, 4 Drawing Figures

JEWEL MOUNTING STRUCTURE

BACKGROUND OF THE INVENTION

1. Field of the Invention

The present invention generally relates to jewelry and more particularly, to jewelry employing moveable settings.

2. Prior Art

The advancement in jewelry design has generally related to the mere employment of artistic techniques to change the material and shapes which are employed. The present invention employs a setting for gems or other aesthetically pleasing elements which is mechanically moveable within the total jewelry structure. It is well recognized that pendants, rings, earrings, etc., have long employed simple, mechanically moveable elements. The simplified structure employed by the pieces displayed in the prior art typically utilize a horizontally or vertically rotating shaft upon which the stone or piece to be shown can be mounted. The designs disclosed by the prior art are structurally simple merely requiring appropriate journelng at the termini of the horizontal or vertical shaft. Even where the orientation of the shaft has been changed, there has still been no attempt to expand the concept into more mechanically, sophisticated areas such as those emmbodied by the present invention.

The present invention comprises a setting for gems or other items to be exhibited which utilizes gravitational forces as an integral function of the jewelry setting. THe present invention substantially resolves the inadequacies displayed by the jewelry structures disclosed by the prior art. A curved mounting guide having a given radius of curvature is mounted atop an internal cavity of a ring, pendant or other form of jewelry. A sleeve is fitted about the guide, the top of the sleeve having a setting for receiving a jewel or other like object. A connector depends inwardly from the bottom portion of the sleeve and terminates in a bearing housing which is adapted to be journeled about a shaft disposed through the cavity of the jewelry enclosure. The shaft about which the bearing housing is journeled is disposed perpendicular to the plane of movement of the sleeve. Weighted means are coupled to the bearing housing on the opposite side thereof from the connector and sleeve. When the jewelry structure is positioned at any angle, gravitational forces will place the weighted means at the lowest position of arc about the shaft thereby causing the sleeve and coupled jewel to be reciprocally moveable along the mounting guide. Through the use of gravitational forces, the mounted jewel will appear to be moveable and yet will always return to a position which lies vertically above the weighted means. The observer will see only the mounted jewel, all remaining elments of the jewelry structure being disposed within the internal cavity of the piece of jewelry.

SUMMARY OF THE INVENTION

The present invention comprises a jewelry structure which employs a moveable setting controllable by gravitational forces. Although the present invention can be used with any type of jewelry structure such as pendants, earrings, bracelets, etc., for the purpose of example only, the present invention shall be discussed with reference to the generalized form of a ring. An outer housing, having substantially oval cross-sections in both its major and minor axis, is mounted upon the ring band employed to the ring on the finger of the user. The housing has an internal cavity which is open along the top surface thereof and along the major axis of the housing. A mounting guide having an uniform radius of curvature is mounted within the opening of the housing, the mounting guide having uniform intervals between the parallel edges thereof and the adjacent edges of the housing. A sleeve is disposed about the guide and adapted to be slideably moveable along the curved portion of the mounting guide. A shaft is coupled within the cavity of the housing, the shaft being disposed across the minor axis of the housing at the center of the radius of curvature of the mounting guide. The sleeve is suitably journeled about the shaft, movement of the sleeve along the mounting guide causing rotation of the coupling journeled to the shaft. A counter-weight is coupled opposite the sleeve, the counter-weight having a mass which is greater than the combined weight of the sleeve, setting and mounted object. Since the sleeve and counter-weight will rotate about the shaft, gravitational forces will tend to maintain the counter-weight at the lowest position of its arc about the shaft. Any movement of the sleeve and coupled jewel setting will cause an equal and opposite movement of the counter-weight which is limited only by the length of the arc of the guide. In addition, if the jewel setting and mounted object are manually deflected along the guide, gravitational forces will cause the mounted object to return to its initial position as a result of gravitational forces acting upon the heavier counter-weight.

It is therefore an object of the present invention to provide an improved jewelry structure.

It is another object of the present invention to provide a jewelry structure which employs a moveable jewel setting.

It is still another object of the present invention to provide a jewelry setting which is moveable through gravitational forces.

It is still yet another object of the present invention to provide an improved jewelry structure which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

DESCRIPTION OF THE PRESENTLY PREFERRED EMBODIMENT

Figure 1:
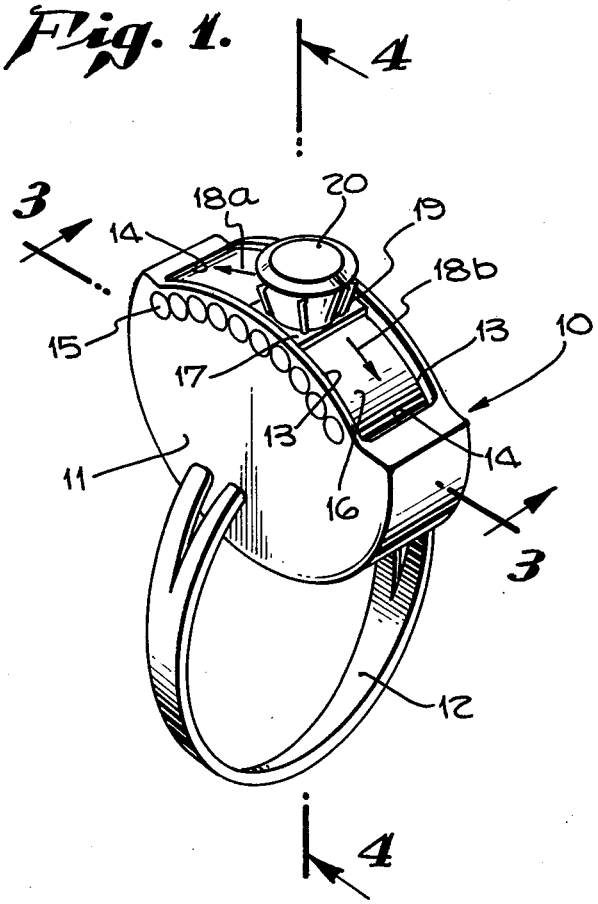
FIG. 1 is a perspective view of a ring constructed in accordance with the present invention.

The present invention comprises a structure to be incorporated within jewelry or other like aesthetically pleasing objects. Although the present invention is equally applicable for use with bracelets, pendants, earrings, etc., the present invention shall be described in connection with a ring. Referring now to FIG. 1, a ring 10 is shown which incorporates the present invention jewel mounting structure. An outer housing 11 is coupled atop the ring band 12, housing 11 having a substantially oval cross-section along its major and minor axis as will be discussed in detail in connection with FIG. 3 and FIG. 4. Housing 11 has a uniform opening along the top thereof which is defined by edges 13 running parallel to the major axis thereof and edges 14 which are substantially parallel to the minor axis of housing 11. Ornamentation 15 is shown disposed adjacent edges 13 and 14, but this is for appearance only and does not form a part of the present invention. As will be discussed in detail hereinbelow, mounting guide 16 is coupled within the opening formed by edges 13 and 14, mounting guide 16 having a uniform radius of curvature. Sleeve 17 is disposed about mounting guide 16 and is adapted to slideably move along the mounting guide 16 in the directions designated by the reference numerals 18*a* and 18*b*. Jewel setting 19 is secured atop sleeve 17, setting 19 being adapted to secure a jewel 20 or any other aesthetically pleasing object which is to be mounted upon ring 10. When constructed in accordance with the present invention, ring 10 will exhibit jewel 20 in a manner whereby jewel 20 will reciprocally move along the full major axis of housing 11, the manner of construction and the operation thereof to be described in detail hereinbelow.

Figure 2:
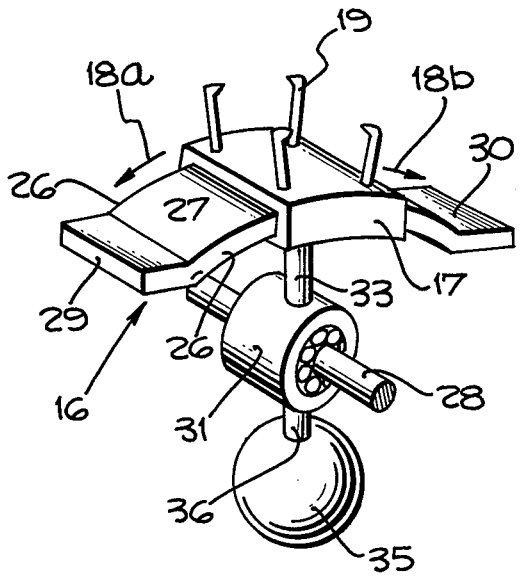
FIG. 2 is a schematic view of the journeled sleeve and counter-weight for mounting an object in accordance with the present invention.
Figure 3:
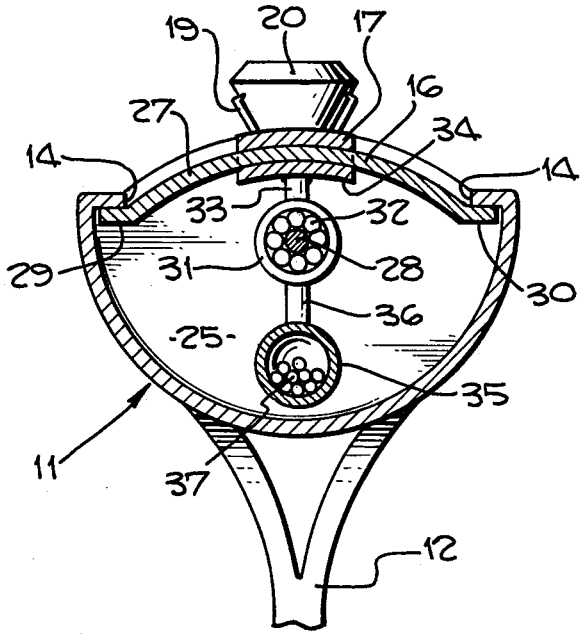
FIG 3 is a cross-sectional, side elevation view of the ring shown in FIG 1 taken through line 3—3 of FIG. 1.
Figure 4:
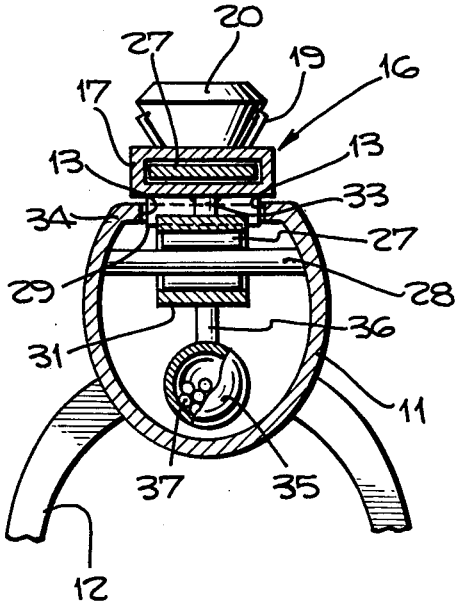
FIG. 4 is a cross-sectional, end elevation view of the ring shown in FIG. 1 taken through line 4—4 of FIG. 1.

As can be best seen by reference to FIG. 3 and FIG. 4, housing 11 comprises an outer shell which has a substantially oval profile along the major axis as shown in FIG. 3 and the minor axis as shown in FIG. 4. Housing 11 encompasses a cavity 25 which encloses the structural elements of the present invention. The upper portion of housing 11 defines a substantially rectangular opening to cavity 25, the rectangular opening being bounded by edges 13 and 14 respectively. Mounting guide 16 comprises three integral sections, the center section 17 being bounded by parallel side surfaces 26 which are parallel to and spaced from edges 13 of housing 11. As can be best seen in FIG. 2 and FIG. 3, section 17 of mounting guide 17 has a uniform radius of curvature centered about shaft 28. Center section 27 of mounting guide 16 depends on either end thereof into planar sections 29 and 30. As can be best seen by reference to FIG. 3, planar sections 29 and 30 are secured adjacent the respective edges 14 of housing 11 to secure mounting guide 16 within the opening bounded by edges 13 and 14. As set forth hereinabove, side surfaces 26 are uniformly spaced from edges 13 to provide for the slidable movement of the sleeve 17.

Sleeve 17 is a substantially rectangular element which defines an internal aperture which is substantially the same shape as center section 27 of mounting guide 16. Sleeve 17 is adapted to slideably move along center section 27 of mounting guide 16 and therefore will have a radius of curvature which is substantially similar to that of center section 27.

Shaft 28 is coupled along the minor axis of housing 11 at the center of curvature of center section 27 of mounting guide 16. A bearing housing 31 is suitably journeled about shaft 28 by conventional means such as ball bearings 32 although the manner of journeling housing 31 about shaft 28 is one of choice. For example, synthetic surfaces such as those manufactured from Teflon could be utilized. A connector 33 is disposed intermediate the bottom surface 34 of sleeve 17 and bearing housing 31 and is securely coupled thereto. Since shaft 28 lies at the center of curvature of section 27 of mounting guide 16, sleeve 17 will be capable of slideably moving back and forth along the surface of mounting guide 16 pursuant to the directional arrows designated by the reference numerals 18*a* and 18*b*.

In order to properly balance sleeve 17 and the mounted jewel 20, they are counterbalanced through the use of weighted element 35. Weighted element 35 is coupled to bearing housing 31 by connector 36 which is aligned with connector 33 and is secured to bearing housing 31 in a diametrically opposed manner. In order to properly position the center of gravity of weighted element 35, weighted element 35 comprises a substantially spherical member which is adapted to hold a plurality of small weights 37 such as ball bearings. The weight of the combination of weighted element 35 and connector 36 is greater than the weight of mounted jewel 20, sleeve 17 and connector 33 with weights 37 causing weighted element 35 to be maintained at its lowermost position by the force of gravity. In this manner, no matter how the user orients ring 10, jewel 20 will move back and forth along mounting guide 17 consistent with the gravitational forces imposed on weighted element 35. It is clear that the movement of mounted jewel 20 can be altered by adjusting the mass of weighted element 35 and weights 37, but so long as that combination exceeds the combined mass of mounted jewel 20, sleeve 17 and connector 33, jewel 20 will visually be returnable to a position consistent with the gravitational forces imposed on the elements journeled about shaft 28.

It can therefore be seen that the present invention comprises a novel jewel mounting structure which incorporates means for moveably positioning a mounted jewel. By incorporating weights to counter the moveable mounted stone, gravitational forces can be utilized to provide a visual effect which is not disclosed by the structures taught in the prior art.

I claim:

1. A jewel mounting structure comprising:

(a) a housing having an internal cavity and a substantially longitudinal opening at the top thereof;

(b) a shaft secured within the cavity of said housing and being disposed perpendicular to the longitudinal opening in said housing;

(c) a mounting guide including a guide portion having a uniform radius of curvature, said mounting guide being coupled to said housing within the opening therein, the interval between the guide portion and said shaft being equal to radius of curvature of said guide portion;

(d) a jewel mounting sleeve having a top and bottom surface and an opening therein, said opening being disposed about the guide portion, said sleeve being adapted to slideably move along the guide portion;

(e) pivot means for journeling said sleeve about said shaft, said means secured to the bottom surface of said sleeve; and (f) weighted means for counterbalancing said jewel mounting sleeve, said weighted means being coupled to said pivot means on the diametrically opposed side of said shaft.

2. A jewel mounting structure as defined in claim 1 including a jewel setting secured to the top surface of said jewel mounting sleeve.

3. A jewel mounting structure defined in claim 1 wherein said housing defines an oval cross-section along its major and minor axis, said longitudinal opening being along the major axis thereof and said shaft being secured within a cavity of said housing along the minor axis of said housing.

4. A jewel mounting structure as defined in claim 1 wherein said pivot means comprises a bearing housing suitably journeled about said shaft and a connector secured intermediate the bottom surface of said sleeve and said bearing housing.

5. A jewel mounting structure as defined in claim 4 wherein said weighted means comprises a spherical enclosure coupled to said bearing housing and aligned with said connector.

6. A jewel mounting structure as defined in claim 5 including a plurality of weighted members disposed within said spherical enclosure.

7. A jewel mounting structure comprising:

(a) a housing defining an internal enclosure, said housing being substantially oval along both its major and minor axis, said housing including a substantially rectangular opening in the top thereof, the longitudinal axis of said rectangular opening being aligned with the major axis of said housing;

(b) a shaft secured within the enclosure of said housing across the minor axis of said housing and being perpendicular to the longitudinal axis of the rectangular opening;

(c) a mounting guide comprising a central guide surface having a uniform radius of curvature and bounded by parallel edges, said mounting guide being coupled to said housing, the edges of said guide surface being spaced from the edges of the rectangular opening in said opening, the interval between said shaft and said central guide surface being equal to the radius of curvature of said central guide surface;

(d) a jewel mounting sleeve having a top and bottom surface and an opening therethrough, the central guide surface being disposed through the opening in said jewel mounting sleeve, said sleeve being adapted to slideably move along said central guide surface;

(e) pivot means journeling said jewel mounting sleeve about said shaft, said pivot means secured to the bottom surface of said jewel mounting sleeve; and (f) weighted means for counterbalancing said jewel mounting sleeve, said weighted means being coupled to said pivot means on the opposite side of said shaft from said pivot means.

8. A jewel mounting structure as defined in claim 7 including a jewel setting secured to the top surface of said jewel mounting sleeve.

9. A jewel mounting structure as defined in claim 7 wherein said pivot means comprises a bearing housing suitably journeled about said shaft and a connector secured intermediate the bottom surface of said jewel mounting sleeve and said bearing housing.

10. A jewel mounting structure as defined in claim 9 wherein said weighted means comprises a spherical enclosure coupled to said bearing housing diametrically opposed to and aligned with said connector, a plurality of weighted elements being disposed within said spherical enclosure.

* * * * *